US007792764B2

(12) United States Patent
Collings

(10) Patent No.: US 7,792,764 B2
(45) Date of Patent: Sep. 7, 2010

(54) DIMENSIONAL RATING DEVICE FOR MAIL PIECES

(75) Inventor: Peter T. Collings, Shelton, CT (US)

(73) Assignee: Pitney Bowes Inc., Stamford, CT (US)

( * ) Notice: Subject to any disclaimer, the term of this patent is extended or adjusted under 35 U.S.C. 154(b) by 729 days.

(21) Appl. No.: 11/450,775

(22) Filed: Jun. 9, 2006

(65) Prior Publication Data

US 2007/0288402 A1 Dec. 13, 2007

(51) Int. Cl.

| | |
|---|---|
| ***G01G 19/413*** | (2006.01) |
| ***G06F 17/00*** | (2006.01) |
| ***G07B 17/02*** | (2006.01) |
| ***G01B 3/00*** | (2006.01) |
| ***G01B 3/14*** | (2006.01) |

(52) U.S. Cl. ..... 705/407; 33/501; 33/562

(58) Field of Classification Search ..... None
See application file for complete search history.

(56) References Cited

U.S. PATENT DOCUMENTS 2,688,878 A * 9/1954 Kolisch ..... 73/865
2,896,333 A * 7/1959 Kivela ..... 33/679.1
6,097,594 A * 8/2000 Bassett et al. ..... 361/685
6,138,371 A 10/2000 Lippa et al.

FOREIGN PATENT DOCUMENTS

| | | |
|---|---|---|
| DE | 9305197 | 8/1993 |
| DE | 9306130 | 8/1993 |
| DE | 9307878 | 10/1993 |
| DE | 9306982 | 11/1993 |

OTHER PUBLICATIONS

USPS, Measuring Tips, Apr. 7, 2006, http://webarchive.org/web/20060407065314/http://www.usps.com/send/preparemalandpackages/measuringtips.htm#table retrieved May 7, 2010.*
Royal Mail Group plc, Pricing in Proportion Letter Size Guide, 2005.

* cited by examiner

*Primary Examiner*—John W Hayes
*Assistant Examiner*—George Chen
(74) *Attorney, Agent, or Firm*—Brian A. Lemm; Angelo N. Chaclas

(57) ABSTRACT

A fixture for rating mail pieces for determination of postage payments includes a generally planar member. The member has formed therein a recess defined at least partially by a floor and at least four side walls. The recess has at least some dimensions that correspond in magnitude to dimensions used to define a first postal category of mail pieces. A second, smaller recess may be nested inside the first recess to indicate the dimensions for another category of mail pieces.

17 Claims, 3 Drawing Sheets

DIMENSIONAL RATING DEVICE FOR MAIL PIECES

BACKGROUND

This invention is directed to a device that allows easy determination of the dimensional class of mail pieces.

Postal requirements in various countries are now utilizing dimensions of each mail piece, as well as the weight, to determine delivery charges. For purposes of dimensional mail piece rating, there are several different categories each bounded by maximum dimensions of length, width and thickness.

A simple, but not convenient or always effective, manner of determining the dimensions of a mail piece is to hold a ruler or tape measure to each of the three dimensions of the mail piece and to read the length/width/thickness of the mail piece from the rule/tape measure scale. If the thickness of the mail piece is greatest away from its periphery, it may not be feasible to get an accurate thickness measurement by this method.

A somewhat more sophisticated approach uses a cardboard template that has the length and width limits displayed together as a rectangle. The template may also include a slot through which the mail piece may be passed to test for compliance with the thickness limit. However, there is considerable room for error in attempting to match the edges of the mail piece to the sides of the template rectangle, or in the user's view point in trying to appraise whether the envelope fits within the rectangle boundaries in close cases. Also, it may be somewhat awkward to pass the mail piece through the slot, even assuming the mail piece is thin enough to fit.

SUMMARY

According to an aspect of the invention, a fixture for rating mail pieces for determination of postage payments includes a generally planar member. The member has formed therein a recess defined at least in part by a floor and at least four side walls. The recess has at least some dimensions that correspond in magnitude to dimensions used to define a first postal category of mail pieces.

The member, in addition to the recess previously mentioned, may have a second recess formed therein. The second recess is defined at least partially by a floor and at least four side walls. The second recess has at least some dimensions that correspond in magnitude to dimensions used to define a second postal category of mail pieces. The second recess is smaller than the first recess and may (but need not) be formed in the floor of the first recess.

The member may have a first slot that passes entirely through the member, with the first slot having at least one dimension that corresponds in magnitude to a dimension used to define the first postal category. The member may also have a second slot passing entirely through the member, with the second slot having at least one dimension that corresponds in magnitude to a dimension used to define the second postal category. The second slot may be smaller than the first slot.

In another aspect, a method of rating a mail piece includes providing a fixture which has a recess formed therein, and placing the mail piece in the recess to determine a postal rating category for the mail piece.

The fixture may have two recesses formed therein, and the mail piece may be placed in one of the recesses after being placed in another of the recesses. The fixture may include a slot, and the mail piece may be passed entirely through the slot.

Therefore, it should now be apparent that the invention substantially achieves all the above aspects and advantages. Additional aspects and advantages of the invention will be set forth in the description that follows, and in part will be obvious from the description, or may be learned by practice of the invention. Various features and embodiments are further described in the following figures, description and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

The fixture of the present invention provides an easy way to determine into which category a mail piece belongs without having to measure each mail piece. A user of the fixture is able to make a reliable rating determination with a minimum of effort. The fixture has a top portion or member with a plurality of different sized recesses or wells, with the smaller recess or recesses located within the larger recess or recesses. The number of recesses is preferably equal to one less than the number of mail piece categories for purposes of postal rating by dimensions.

The largest recess is sized to hold a mail piece that falls into the second largest category for dimensional rating purposes. If a mail piece does not fit into the largest recess, it falls into the largest category for dimensional rating purposes. The remaining recess or recesses are located within the largest recess and are sized to hold mail pieces that fall into each respective dimensional rating category. The depth of each recess is preferably equal to the maximum thickness defined for the corresponding dimensional rating category.

To give a preview of a manner of using the fixture, a user may place a mail piece onto the fixture to determine into which of the recesses the mail piece fits. Based on the recess into which the mail piece fits, the user may determine the dimensional rating category that applies to the mail piece. Thus, if the mail piece fits into the smallest (or smaller) recess, the standard (smallest) size category applies, and an additional charge for oversize mail would not be applicable. If the mail piece does not fit in the smallest (smaller) recess, but fits into (one of) the large(r) recess(es), the user can easily determine the applicable size category based on the recess into which the mail piece fits. Thus determining which, if any, oversize surcharge applies is based on which recess the mail piece fits. If a mail piece does not fit in the largest (larger) recess, then the largest dimensional rating category applies.

The fixture preferably also includes slots that are sized according to thickness breaks for the dimensional rating categories. If the user is not sure, based on using the recesses, whether the thickness limit is met, the user may attempt to pass the mail piece through the corresponding slot. If the mail piece passes through the slot, then it does not exceed the maximum thickness allowed for the corresponding rating category. If the mail piece does not fit through the slot for a particular rating category, it must be rated in the next larger category.

Figure 1:
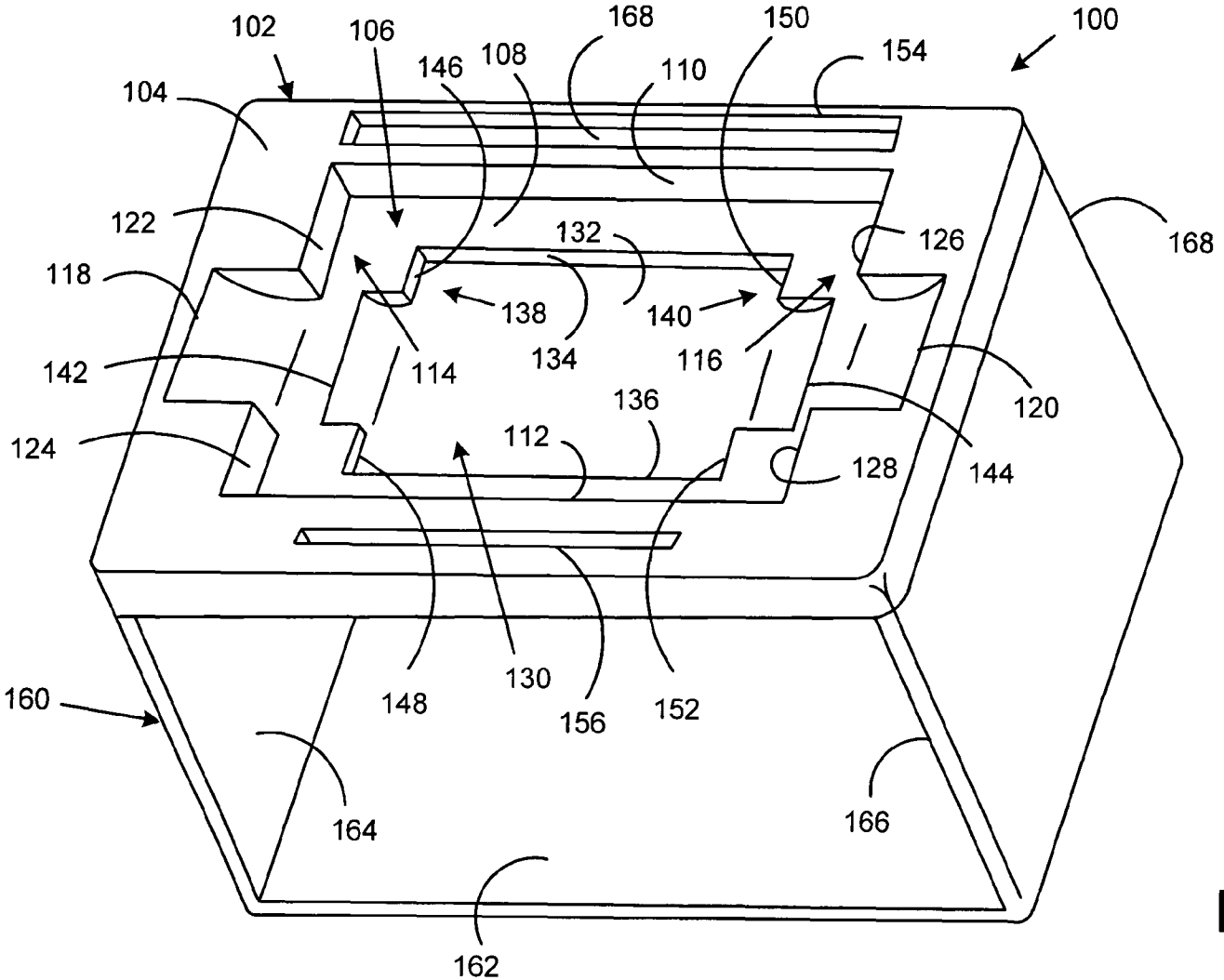
FIG. 1 is an isometric view of a mail piece dimensional rating fixture in accordance with an embodiment of the invention.

FIG. 1 is an isometric view of a mail piece dimensional rating fixture 100 provided in accordance with an embodiment of the invention.

The fixture 100 includes a generally planar top member 102. The top surface 104 of the member 102 has a recess 106 formed therein. The recess 106 is defined by a floor 108, by length side walls 110, 112 and by width side walls 114, 116. The width side walls 114, 116 are interrupted, respectively, by finger guides 118, 120 so that sub-walls 122, 124 are formed from width side wall 114 and sub-walls 126, 128 are formed from width side wall 116. The side wall 110, side wall 114 and floor 108 are mutually orthogonal. The side walls 110, 112 are parallel to each other and the side walls 114, 116 are parallel to each other.

The dimensions of the recess 106 correspond in magnitude to the maximum dimensions for a particular mail piece size rating category in a particular postal authority dimensional rating scheme. In one embodiment, the fixture is useful for a dimensional rating scheme proposed by the British Post Office, which calls for three size categories: "Letter", "Large Letter" and "Parcel", stated in order of increasing size. The recess 106 indicates the maximum dimensions for qualification for the "Large Letter" category. Accordingly, the length side walls 110 and 112 each have a length that is equal to the maximum length for the "Large Letter" category. The width side walls 114, 116 each have a length, measured from length side wall 110 to length side wall 112, that is equal to the maximum width for the "Large Letter" category. The side walls 110, 112, 114, 116 each have a height (equal to the depth of the recess 106 as measured at the side walls) that is equal to the maximum thickness for the "Large Letter" category.

The floor 108 of the recess 106 has a smaller recess 130 formed therein. The recess 130 is defined by a floor 132, by length side walls 134, 136 and by width side walls 138, 140. The width side walls 138, 140 are interrupted, respectively, by finger guides 142, 144 so that sub-walls 146, 148 are formed from width side wall 138 and sub-walls 150, 152 are formed from width side wall 140. The side wall 134, side wall 138 and floor 132 are mutually orthogonal. The side walls 134, 136 are parallel to each other, and the side walls 138, 140 are parallel to each other.

The floor 132 of recess 130 is parallel in its orientation to the orientation of the floor 108 of recess 106. The length side walls 134, 136 of recess 130 are parallel in their orientation to the orientation of length side walls 110, 112 of recess 106. It follows from the mutual orthogonalities mentioned above that the width side walls 138, 140 of recess 130 are parallel in their orientation to the orientation of width side walls 114, 116 of recess 106.

The dimensions of the recess 130 correspond in magnitude to the maximum dimensions for the "Letter" category and thus the recess 130 indicates the maximum dimensions for that category. Thus the length side walls 134, 136 each have a length that is equal to the maximum length for the "Letter" category. The width side walls 138, 140 each have a length, measured from length side wall 134 to length side wall 136, that is equal to the maximum width for the "Letter" category. The side walls 134, 136, 138, 140 each have a height (equal to the depth of the recess 130) that is equal to the maximum thickness for the "Letter" category.

The member 102 also has slots 154, 156 which pass entirely through the member 102 from its top surface 104 to its bottom surface (not visible in drawing). Slot 154 has a horizontal cross-section which corresponds to its opening and which has a length and width which are equal respectively to the length and height of the side walls 110, 112 of the recess 106. Thus the width of the slot 154 is equal to the maximum thickness for the "Large Letter" rating category, and the length of the slot 154 is equal to the maximum length for the "Large Letter" category.

The slot 156 has a horizontal cross-section which corresponds to its opening and which has a length and width which are equal respectively to the length and height of the side walls 134, 136 of the recess 130. Thus the width of the slot 156 is equal to the maximum thickness for the "Letter" category, and the length of the slot 156 is equal to the maximum length for the "Letter" category.

Of course, the depth of each slot, from top opening to bottom opening, is equal to the thickness of member 102, and is not critical.

In one embodiment, for the above mentioned Letter/Large Letter/Parcel rating scheme, the maximum dimensions for the "Large Letter" category, and hence the dimensions of the recess 106, are 353 mm×250 mm×25 mm; the maximum dimensions for the "Letter" category, and hence the dimensions of the recess 130, are 240 mm×165 mm×5 mm.

The finger guides 118, 120, 142, 144 are optionally provided to make it easier for the user to remove mail pieces from the recesses. Each finger guide slopes in a curved manner inwardly and downwardly to the floor of its respective recess.

Figure 2:
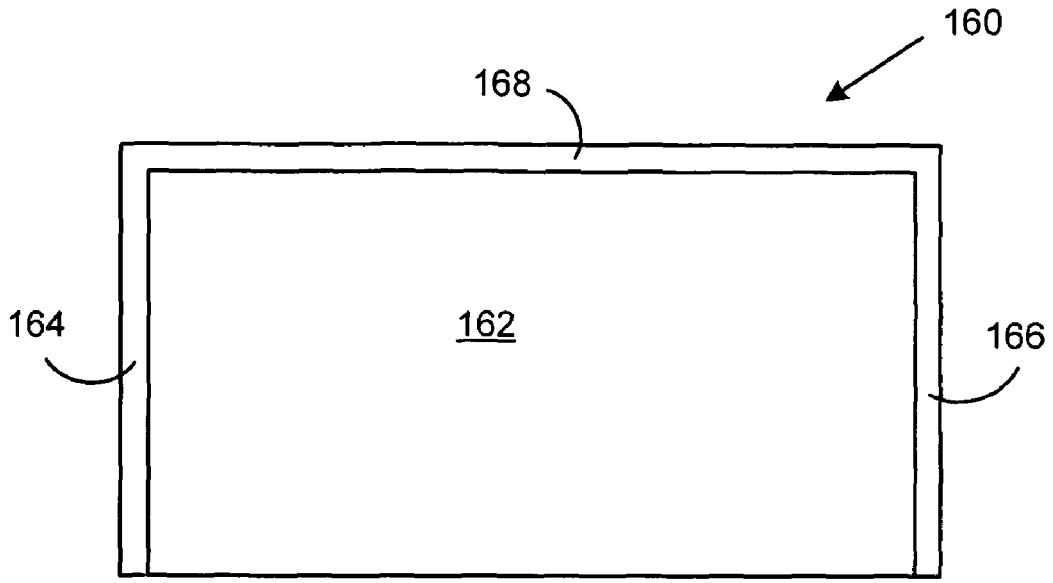
FIG. 2 is a cross-sectional view of the fixture of FIG. 1, taken in a horizontal plane.

The fixture 100 may further include a frame 160 which supports the top member 102. In some embodiments, the member 102 rests on the frame 160 without being secured thereto. The frame 160 may include a base 162, side walls 164, 166 and a rear wall 168 (FIG. 2; a small portion of rear wall 168 also visible through slot 154, FIG. 1). The walls 164, 166, 168 rise from the periphery of base 162 and may be integrally formed therewith. The member 102 is supported on the tops of the walls 164, 166, 168.

It will be recognized that the frame 160 may have many other configurations besides the solid/continuous walls/base illustrated. For example, the rear wall 168 and base 162 may be omitted with the member 102 supported on legs at its corners, the legs being joined by cross-braces at the top. However, the solid walls shown may be advantageous, particularly the rear wall, in containing a mail piece passed through one or the other of the slots 154, 156.

The frame 160 may be dimensioned such that the height of the walls 164, 166, 168 is greater than the maximum length for the "Large Letter" rating category (i.e., greater than the length of the slot 154 and of the recess 106) to allow a mail piece in the "Large Letter" category to pass entirely through the slot 154 even if inserted therein lengthwise.

The layout of the recesses and the slots on the member 102 may also readily be varied. In some embodiments, writings, markings and/or labels and the like may be present on the top surface of member 102 to remind/instruct the user as to specific ratings determinations to be made according to which recess/slot the mail piece fits in or passes through.

Either or both of the member 102 and the frame 160 may be made of molded plastic or of another material or materials.

Figure 3:
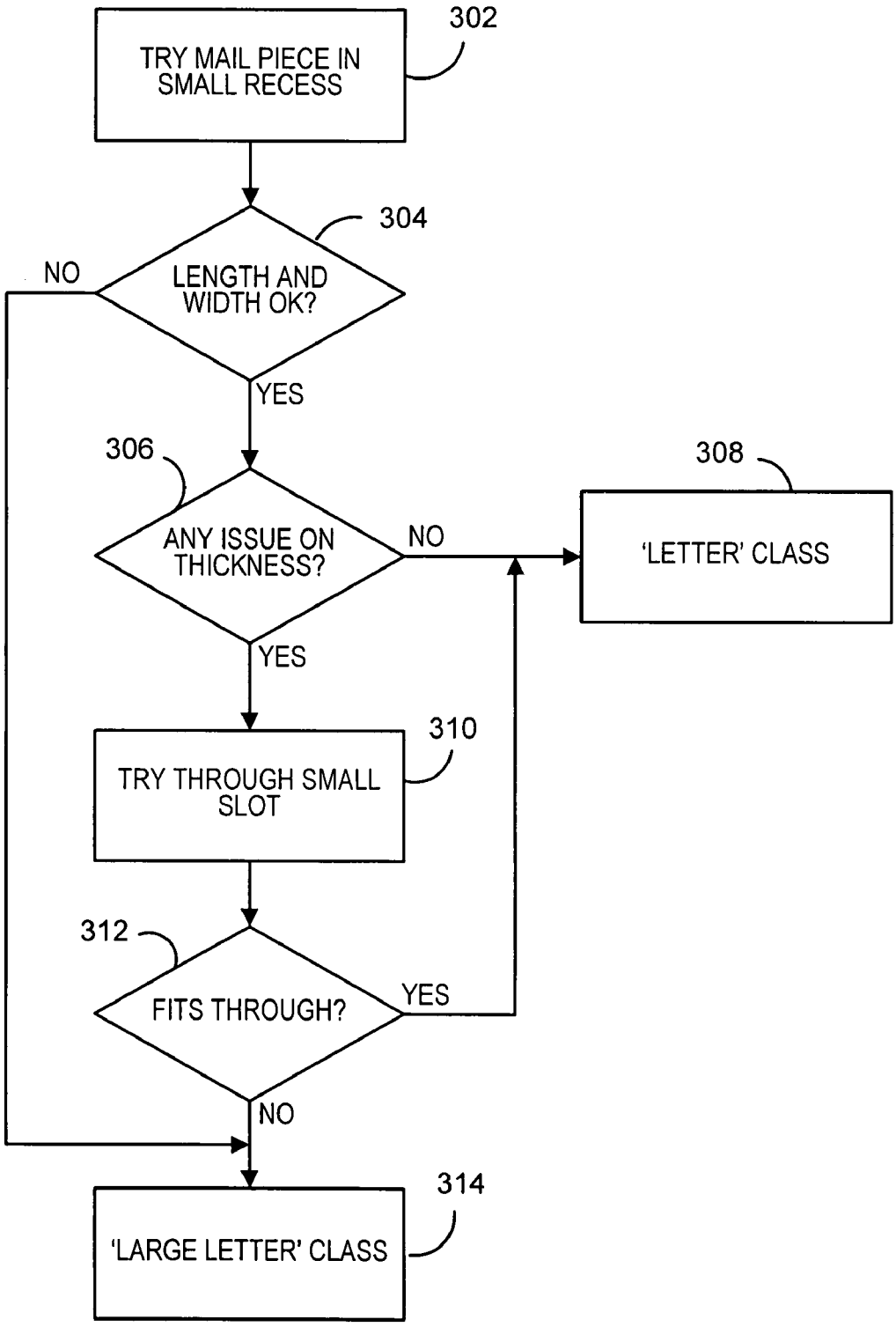
FIG. 3 is a flow chart that illustrates a process for using the fixture of FIG. 1.

FIG. 3 is a flow chart that illustrates a process for using the fixture 100. Each of the actions, decisions and conclusions indicated in FIG. 3 may be performed or determined by an individual user of the fixture 100.

In the first instance, it will be assumed that the user recognizes that the mail piece to be rated is rather close to the maximum size for the "Letter" category. Accordingly, the user proceeds, as indicated at 302 in FIG. 3, to try to fit the mail piece in recess 130. In doing so, the user first passes the mail piece through the space defined by the side walls of recess 106. Thus mail piece is effectively placed first in the larger recess 106 and then, if possible, in the smaller recess 130 formed in the floor of recess 106.

At 304, the user determines whether the length and width of the mail piece are such that the mail piece fits in the recess 130. If so, then the user considers, at 306, whether the thickness of the mail piece is such that it is not clear whether the upper surface of the mail piece extends above the side walls of the recess 130 when the mail piece rests on the floor of recess 130. If it is clear that the thickness of the mail piece does not cause it to extend above the recess 130, then the user concludes at 308 that the mail piece is small enough to be categorized in the "Letter" category.

If at 306 the user has a question as to whether the mail piece is too thick for the "Letter" category, then he/she may, at 310, try to pass the mail piece through the slot 156. Decision block 312 represents the user's determination as to whether the mail piece fits through slot 156. If the mail piece fits through the slot 156, the user concludes (308) that the mail piece is in the "Letter" category. If the mail piece does not fit through the slot 156, then the user concludes (314) that the mail piece is in the "Large Letter" category.

Considering again the determination at 304, if either or both of the length and width of the mail piece are such that the mail piece does not fit in the recess 130, then the user concludes (314) that the mail piece is in the "Large Letter" category.

Let it next be assumed that the mail piece to be rated is clearly too large to fit in the small recess 130 but is somewhat or very close in size to the large recess 106. In that case, the user may perform the process set forth in FIG. 3, but with respect to the large recess 106 instead of the small recess 130 (for block 302) and/or with respect to the large slot 154 instead of the small slot 156 (for block 310). In this case the process of FIG. 3 is further modified such that the conclusion the user draws at 308 is that the mail piece is in the "Large Letter" category, or the conclusion the user draws at 314 is that the mail piece is in the "Parcel" category.

One other possible process modification should also be considered, for the case where the length and width of the mail piece are small enough to fit the small recess 130, but the thickness is considerably greater than the small slot 156 would accommodate. The user should be alert in this case also to try the mail piece in the large slot 154, and to rate the mail piece as a "Parcel" if the mail piece does not pass through the large slot 154.

Figure 4:
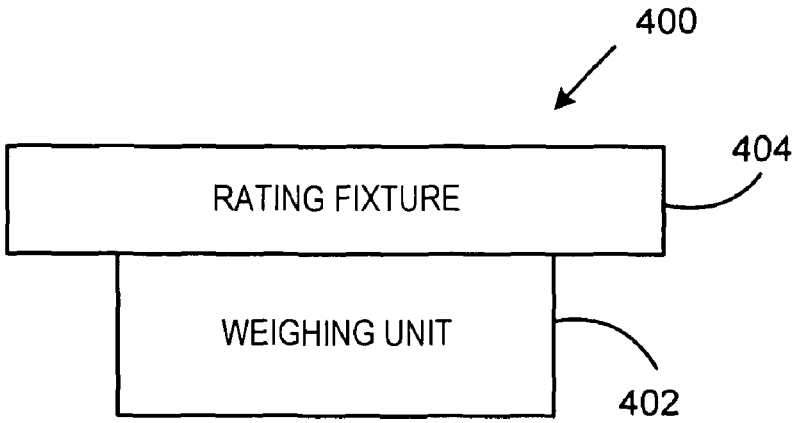
FIG. 4 is a schematic side view showing a postal scale provided according to another embodiment of the invention.

FIG. 4 is a schematic side view showing a postal scale 400 provided according to another embodiment of the invention. The postal scale includes a weighing unit 402 (comprising a load cell, e.g., which is not separately shown) and a dimensional rating fixture 404 supported on the weighing unit 402. The rating fixture 404 may take the form of the member 102 shown in FIG. 1 or alternatively may comprise as well a frame such as frame 160 with a member like member 102 supported thereon. The weighing unit 402 may be operative to generate a weight signal and/or weight data that represents the weight of a mail piece (not shown) placed on the rating fixture 404. The rating fixture 404 facilitates dimensional rating of the mail piece. With the postal scale illustrated in FIG. 4, postal rating of a mail piece both by weight and dimensions may be conveniently performed in a single operation or group of operations. It will be appreciated that the postal scale 400 may also have conventional features and components, such as a user interface, which have not been mentioned hereinabove.

As indicated above, the number of recesses and/or slots provided in the dimensional rating fixture may depend on the number of mail piece dimensional rating categories established by the postal authority for the country in which the fixture is to be used. The configuration illustrated in FIG. 1 is suitable for a three-category dimensional rating scheme. For a rating scheme with only two categories, only one recess and/or slot may be needed. For a rating scheme with four categories, it may be desirable to provide three recesses and/or slots. If three or more recesses are provided, it may be desirable to nest them, as in the embodiment shown in FIG. 1, so that each recess other than the largest is formed in the floor of the next larger recess. With this arrangement, the top member of the fixture need not be much larger than the maximum size for the second largest rating category.

A number of embodiments of the present invention have been described. Nevertheless, it will be understood that various modifications may be made without departing from the spirit and scope of the invention. Other variations relating to implementation of the functions described herein can also be implemented. Accordingly, other embodiments are within the scope of the following claims.

What is claimed is:

1. A fixture for rating a mail piece for determination of postage payments, comprising:

a planar member;

a first recess formed in the planar member, the first recess defined at least partially by a floor and at least four side walls, the first recess having two dimensions that correspond in magnitude to two dimensions used to define a first postal category of mail pieces; and a second recess formed in the floor of the first recess, the second recess defined at least partially by a floor and at least four side walls, the second recess having two dimensions that correspond in magnitude to two dimensions used to define a second postal category of mail pieces, the second recess smaller than the first recess, wherein the second postal category is used to determine postage payments to deliver the mail piece if the mail piece fits into the second recess and the first postal category is used to determine postage payments to deliver the mail piece if the mail pieces fits into the first recess but does not fit into the second recess.

2. The fixture according to claim 1, wherein each recess has three dimensions that correspond in magnitude to three respective dimensions used to define a respective category of mail pieces.

3. The fixture according to claim 2, further comprising:

a first slot passing entirely through the member, the first slot having at least one dimension that corresponds in magnitude to a dimension used to define the first postal category of mail pieces; and a second slot passing entirely through the member, the second slot having at least one dimension that corresponds in magnitude to a dimension used to define the second postal category, the second slot smaller than the first slot.

4. The fixture according to claim 3, wherein:

the first slot has two dimensions that correspond in magnitude to two dimensions of the first recess; and the second slot has two dimensions that correspond in magnitude to two dimensions of the second recess.

5. The fixture according to claim 4, wherein:

the first slot has an opening that corresponds in shape and size to a side wall of the first recess; and the second slot has an opening that corresponds in shape and size to a side wall of the second recess.

6. The fixture according to claim 1, further comprising:

a first pair of finger guides formed in the member, the first pair of finger guides adjacent and communicating with the first recess, each finger guide of the first pair of finger guides positioned to interrupt a respective side wall of the first recess; and and a second pair of finger guides formed in the member, the second pair of finger guides adjacent and communicating with the second recess, each finger guide of the second pair of finger guides positioned to interrupt a respective side wall of the second recess.

7. The fixture according to claim 1, further comprising:

a frame that supports said member, such that said member is spaced above a surface on which the frame is supported.

8. The fixture according to claim 7, wherein the frame includes a floor and three side walls.

9. The fixture according to claim 8, wherein the member and the frame are formed of molded plastic.

10. The fixture according to claim 7, wherein the frame is dimensioned to support said member above said surface on which the frame is supported by a distance that is greater than a length of the first recess, the first recess having a width that is less than said length of the first recess, the first recess having a depth that is less than said width of the first recess.

11. A postal scale comprising:

a weighing unit; and a fixture supported on the weighing unit, the fixture comprising:

a planar member;

a first recess formed in the planar member, the first recess defined at least partially by a floor and at least four side walls, the first recess having two dimensions that correspond in magnitude to two dimensions used to define a first postal category of mail pieces; and a second recess formed in the floor of the first recess, the second recess defined at least partially by a floor and at least four side walls, the second recess having two dimensions that correspond in magnitude to two dimensions used to define a second postal category of mail pieces, the second recess smaller than the first recess, wherein the second postal category is used to determine postage payments to deliver a mail piece if the mail piece fits into the second recess and the first postal category is used to determine postage payments to deliver the mail piece if the mail pieces fits into the first recess but does not fit into the second recess.

12. The postal scale according to claim 11, further comprising:

a first pair of finger guides formed in the member, the first pair of finger guides adjacent and communicating with the first recess, each finger guide of the first pair of finger guides positioned to interrupt a respective side wall of the first recess; and and a second pair of finger guides formed in the member, the second pair of finger guides adjacent and communicating with the second recess, each finger guide of the second pair of finger guides positioned to interrupt a respective side wall of the second recess.

13. The postal scale according to claim 11, wherein the weighing unit comprises a load cell.

14. A method for rating a mail piece for determination of charges to deliver said mail piece comprising:

determining if the mail piece fits into a first recess formed in a mail piece rating fixture, the first recess defined at least partially by a floor and at least four side walls, the first recess having a first and second dimension that correspond in magnitude to length and width dimensions used to define a first postal category of mail pieces;

if the mail piece fits into the first recess, determining if the mail piece fits into a second recess formed in the floor of the first recess, the second recess defined at least partially by a floor and at least four side walls, the second recess having a first and second dimension that correspond in magnitude to length and width dimensions used to define a second postal category of mail pieces, the second recess smaller than the first recess;

using the second postal category to determine charges to deliver the mail piece if the mail piece fits into the second recess; and using the first postal category to determine charges to deliver the mail piece if the mail piece fits into the first recess but does not fit into the second recess.

15. The method according to claim 14, wherein if the mail piece fits into the first recess but does not fit into the second recess, the method further comprises:

determining if the mail piece fits through a slot passing entirely through the fixture, the slot having a dimension that corresponds in magnitude to a third dimension used to define the first postal category of mail pieces; and using the first postal category to determine charges to deliver the mail piece only if the mail piece fits through the slot.

16. The method according to claim 15, wherein the third dimension is thickness.

17. The method according to claim 14, wherein if the mail piece fits into the second recess, the method further comprises:

determining if the mail piece fits through a slot passing entirely through the member, the slot having a dimension that corresponds in magnitude to a third dimension used to define the second postal category;

using the first postal category to determine charges to deliver the mail piece if the mail piece does not fit through the slot; and using the second postal category to determine charges to deliver the mail piece if the mail piece does fit through the slot.

* * * * *